United States Patent [19]

Ozols

[11] Patent Number: 4,601,131

[45] Date of Patent: Jul. 22, 1986

[54] COUNTERBALANCE SPRING MEANS

[76] Inventor: Roland Ozols, 1335 N. Baker Ave., Ontario, Calif. 91764

[21] Appl. No.: 667,560

[22] Filed: Nov. 2, 1984

[51] Int. Cl.[4] ..... E05D 15/40

[52] U.S. Cl. ..... 49/206; 160/191

[58] Field of Search ..... 49/200, 206; 160/189, 160/191, 192

[56] References Cited

U.S. PATENT DOCUMENTS

| | | | |
|---|---|---|---|
| 2,023,909 | 10/1935 | Wread | 49/200 |
| 2,195,875 | 4/1940 | Pixley | 49/206 |
| 3,402,922 | 9/1968 | McCan | 49/206 X |
| 3,429,072 | 2/1969 | Sammons | 160/191 X |
| 3,680,259 | 8/1972 | Andresen | 49/206 |
| 4,082,133 | 4/1978 | Halopoff | 160/191 |
| 4,235,047 | 11/1980 | Turner | 49/206 X |

FOREIGN PATENT DOCUMENTS

| | | | |
|---|---|---|---|
| 1584043 | 3/1969 | Fed. Rep. of Germany | 49/200 |

*Primary Examiner*—Philip C. Kannan

*Attorney, Agent, or Firm*—John H. Crowe

[57] ABSTRACT

A spring assembly for use in place of the spiral tension springs in conventional spring-loaded counterbalancing systems for garage doors. It is made up of a compression spring and traveling pulley in a tubular housing, the compression spring being mounted above the pulley. A cable extends around the pulley from an anchored end to interconnection with the kicker assembly of the mounting hardware for tension springs in an ordinary garage door counterbalancing system so that closing of the door causes the cable to pull up on the pulley and compress the spring. There is virtually no possibility that the compressed spring will rupture and emit flying fragments, but even if this occurred the housing would prevent the escape of such fragments to the surroundings.

8 Claims, 3 Drawing Figures

COUNTERBALANCE SPRING MEANS

BACKGROUND OF THE INVENTION

This invention relates generally to counterbalance spring assemblies for use on heavy doors mounted to swing between open, overhead positions and closed positions, and more particularly to such assemblies adapted for use on two-car garage doors with substantially no risk of spring breakage, or damage or injury from broken spring fragments in the unlikely event of such breakage.

Many homes today have double garages with heavy, spring-loaded doors adapted to swing between horizontal overhead (open) positions and vertical (closed) positions. Such a door is typically counterbalanced with tension springs so mounted as to come under high stretching tension when the door is closed and to help pull the door to its open position after it has been moved partly in that direction from a closed position by an outward pull on a handle on the bottom half of its outer side. These springs often break when the garage door is closed and they are under tension. At times in the past when this has occurred, metal spring fragments have been released with great force to damage whatever they struck. There have even been instances of grave injury to persons who have been struck by such fragments. While past attempts have been made to minimize the dangers inherent in such spring assemblies, none has been entirely successful. In this connection, some jurisdictions now require that spiral tension springs sold for use in such assemblies be equipped with internal safety wires, or the like, intended to prevent the flying escape of most spring fragments in the event of spring breakage. The presence of such wires does not necessarily prevent the release of all spring fragments, however. U.S. Pat. No. 3,402,922, which was granted to Henry F. McCan in 1968, discloses a telescoping shield adapted for installation around conventional garage door counterbalance springs, but no such product is available on the market insofar as I am aware.

In addition to the safety hazard inherent in the conventional garage door spring assemblies referred to above, such assemblies have other disadvantages. Thus, when a spring breaks it is virtually impossible for even a strong man to open the affected door without additional help. When the door is finally opened, generally by the brute strength of at least two men, it must be propped open while the broken spring is replaced. The replacement of the spring, itself, is difficult, and, in fact, impossible for the average woman and many men to accomplish. Where pairs of springs are employed, as they generally are, and both springs of a pair break, this compounds the difficulty of opening the door and repairing the spring assembly. If the garage door is not adequately supported in its open position while the spring assembly is undergoing repair, it can slip away from its support and close with enough force to severely injure or even kill anyone close-by who does not move out of the way fast enough.

In short, conventional spring-mounted garage doors of the above-described type pose an ever present risk of damage to property and injury to persons as a result of spring breakage, which can occur without warning at any time. Additionally, such breakage can cause great inconvenience and create an additional risk of injury from the unbalanced door while repair work is going on.

SUMMARY OF THE INVENTION

The spring assembly of this invention provides an improved alternative to the conventional tension spring arrangement for garage doors of the abovedescribed type. To that end it utilizes a compression spring and cooperating pulley to achieve the necessary counterbalancing force to hold the door in its open position. As will be seen, the pulley is mounted to ride beneath a spiral compression spring in a tubular housing and a cable is looped around it from a fixed anchor point at one end at the top of the housing to a free opposite end. My spring assembly is mounted on a garage door frame in combination with the same hardware used for the mounting of conventional tension springs, the free end of its cable being pivotally fastened to the kicker assembly of such hardware as are the tension springs in the ordinary garage door setup. As a result of this arrangement, opening of the garage door causes the kicker assembly to pull upwardly on the cable which, in turn, pulls upwardly on the pulley, which is designed to ride freely within the tubular housing. The upward movement of the pulley compresses the compression spring and results in a sufficient increase in the length of cable extending from the tubular housing to the kicker assembly to permit the door to close. When the door is completely closed, the spring, being under compression, is almost immune to breakage, as opposed to the conventional garage door springs that are under tension when the door is closed and therefore quite vulnerable to breakage. Even if the compression spring should break, which is extremely unlikely, its parts would not scatter the way the parts of a spring under tension tend to scatter when it breaks, but even if they did, the tubular housing would prevent the escape of spring fragments into the surroundings. While this description has been couched in terms of reference to a single spring, it should be understood that, for purposes of simplicity, the discussion has been limited to the spring assembly at one side of a garage door, and that this assembly has a mirror image counterpart on the other side of the door including a second spring similar to the first.

It is thus a principle object of this invention to provide a spring assembly for heavy spring-loaded doors that is completely free of any risk of damage to property or injury to persons as a result of spring breakage.

Another object of the invention is to provide such a spring assembly that is virtually free from the consequent problems of garage access accompanying spring breakage in conventional garage door spring assemblies.

Still another object of the invention is to provide such a spring assembly that is virtually free of any necessity for repairing broken springs with the attendant risk of injury to persons while repairs are being made.

Other objects, features and advantages of the invention will become apparent in the light of subsequent disclosures herein.

DESCRIPTION OF THE PREFERRED EMBODIMENT

Figure 1:
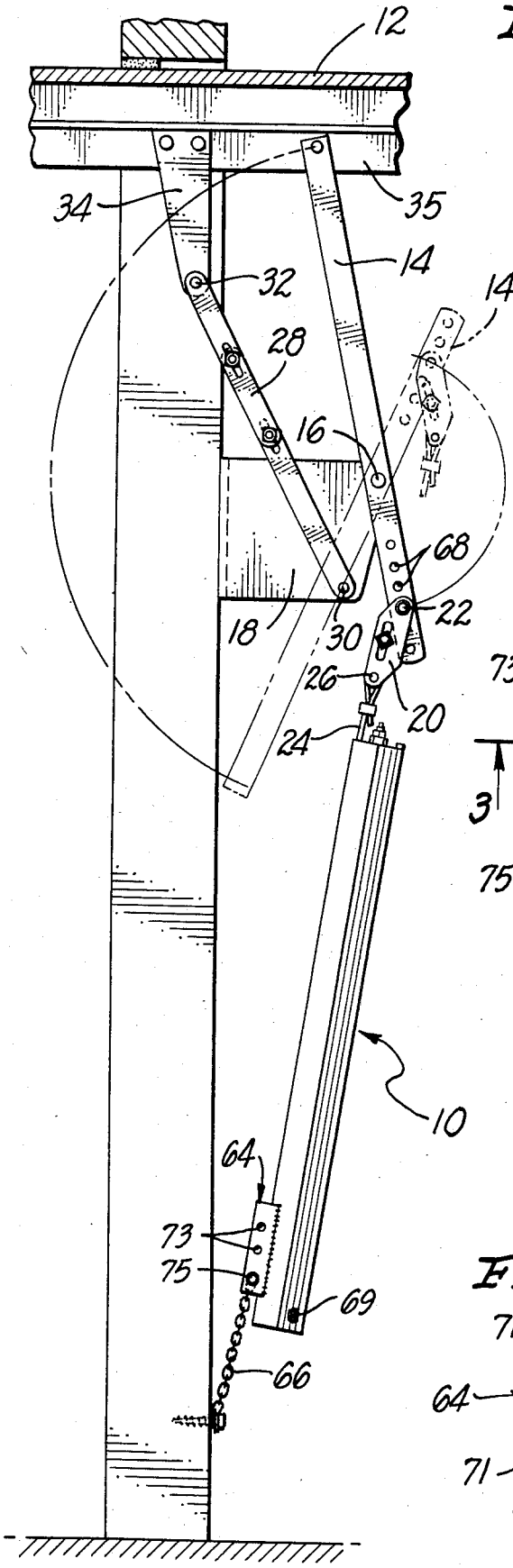
FIG. 1 is a side elevational view of a preferred embodiment of a spring assembly in accordance with this invention mounted for use in combination with hardware similar to that employed for the mounting of tension springs of the conventional type on spring-loaded garage doors, the garage door and door frame being shown fragmentarily.

FIG. 1 of the drawing shows, at 10, a spring assembly in accordance with this invention mounted for use in combination with conventional hardware for spring-loaded garage doors to effectuate the easy opening and closing of a garage door 12. The hardware includes a lever 14 pivotally mounted at 16 intermediate its ends on a bracket plate 18. Near the lower end of the lever, as seen in FIG. 1, a kicker assembly 20 is pivotally mounted at 22. The looped end of a cable 24 forming part of spring assembly 10 encircles a pivot pin 26 on the kicker assembly 20, as shown. An adjustable two-piece strut 28 of conventional type is pivotally attached at 30 to the bracket plate 18 at one end, and at 32, at the other end, to a bracket 34 that is anchored to an angle bracket 35 which is fastened to the garage door 12.

Figure 3:
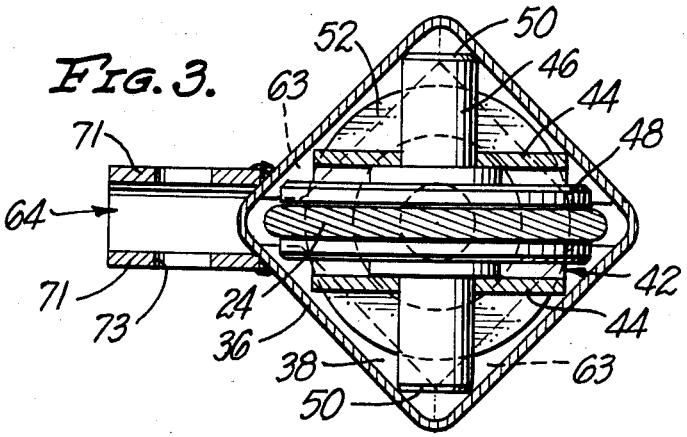
FIG. 3 is a view of the spring assembly taken mostly in section along line 3—3 of FIG. 2.

The spring assembly 10 includes an elongate metal housing 36 of square cross section, open at the bottom and partially enclosed at the top by a metallic closure 38. Coaxially disposed within the tubular housing 36 is a rod 40, threaded from the top for a portion of its length and fixedly secured at its bottom end to the top of a pulley keeper 42 having parallel sides 44 penetrated by an axle 46 for a pulley 48. The axle 46 has annular bevels 50 around its two ends, and is positioned diagonally between two corners of the housing 36, as illustrated in FIG. 3. The annular bevels at the ends of the axle are slightly spaced from the angled walls of housing 36 to permit substantially free up and down movement of the pulley assembly within the housing as will be described.

Figure 2:
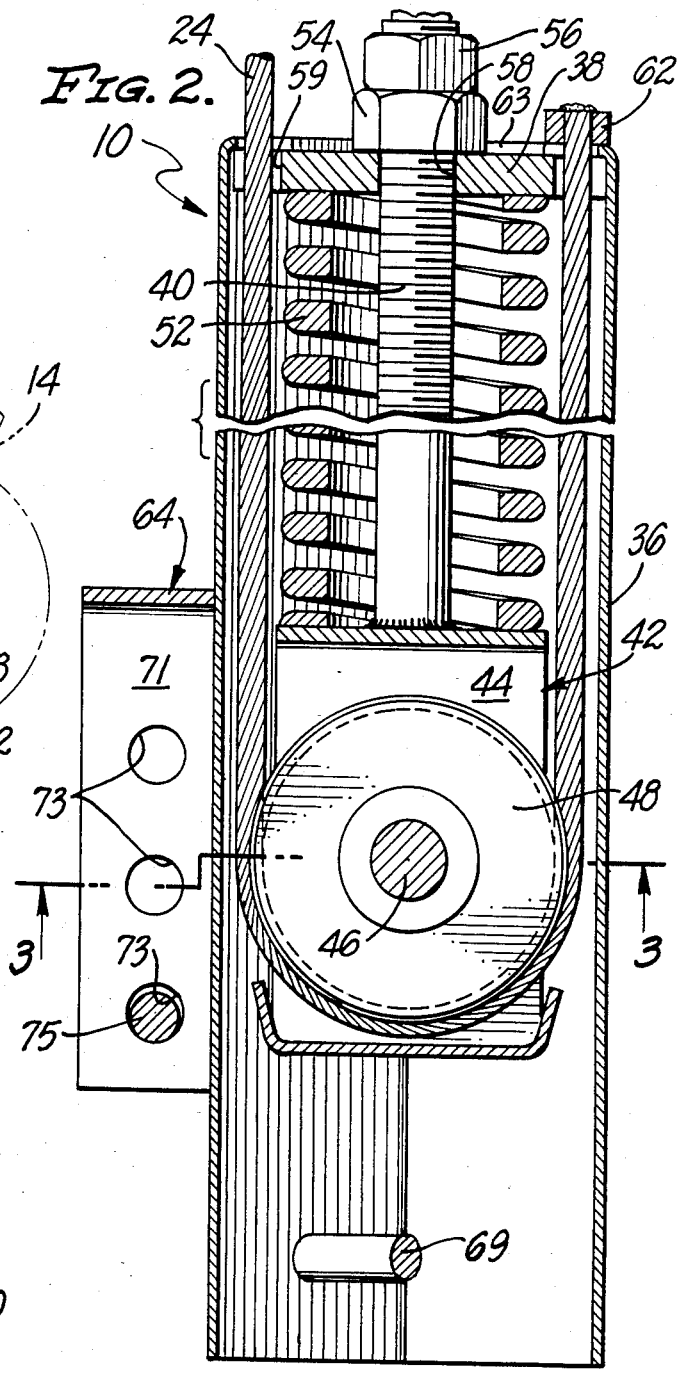
FIG. 2 is an enlarged interrupted view, mostly in longitudinal section, of the spring assembly.

A compression spring 52 is interposed between the top closure 38 of tubular housing 36 and the top of keeper 42. This spring normally exerts downward force on keeper 42, the degree of which can be adjusted by means of a nut 54 and a cooperating lock nut 56 threaded downwardly onto the rod 40 and bearing on the top closure of housing 36 as a result of the spring force. While, as indicated the nut 54 and lock nut 56 provide a degree of adjustability of the spring assembly, their primary purpose is for ease of installation of the assembly for use. Top closure 38 has a central opening 58 to loosely admit the rod 40, as shown in FIG. 2. The cable 24 is fixedly secured to a nut 62 which nut is, in turn, fixedly secured, by welding means, to inturned portions 63 of the tops of the walls of housing 36 adjacent that corner of the housing shown at the right in FIGS. 2 and 3. From its anchor point at that corner, the cable 24 loops down around the pulley 48 and up through an opening 59 in top closure 38 in the corner of the housing opposite to that at which nut 62 is secured. From the housing, the cable extends upwardly to termination in the aforesaid loop encircling pivot pin 26 (which bridges parallel side plates of the kicker assembly 20). As will be apparent, there is no necessity that top closure 38 be welded or otherwise attached to the walls of housing 36 since spring 52 holds it in position in the assembly after it is installed. Its freedom from attachment also aids in the installation of the assembly.

As previously indicated, the kicker assembly is of conventional type, comprising a pair of metallic side plates fastened together near their bottom ends by the pin 26, having corresponding slots in which a nut and bolt can be slidably adjusted and opposite openings in their upper ends in which another nut-and-bolt fastening is inserted. The kicker assembly is pivotally secured to the lever 14 near its lower end in conventional fashion by engagement of its upper nut and bolt with a suitable one of a plurality of openings 68 therethrough to achieve optimum counterbalance of the heavy door for opening and closing purposes. The lower nut and bolt of the kicker assembly can be moved longitudinally along the slots in the kicker assembly sides and tightened in position for further adjustment of the counterbalance. Since all of this hardware is conventional, it need not be described in any greater detail here.

At its bottom end, the housing 36 has an adjustment bracket 64 extending outwardly from its left-hand corner, as seen in FIG. 1. This adjustment bracket is used for anchoring the lower end of the housing 36 to the side frame of the garage door by means of a chain 66 in the manner in which such a chain is employed to anchor the lower end of a spring, or pair of springs, in a conventional spring-loaded garage door setup. The housing has a transverse nut-and-bolt stop 69 positioned near its bottom end, as illustrated in FIGS. 1 and 2.

The manner in which my novel spring assembly functions should now, it is believed, be clear. FIG. 1 shows the assembly with compression spring 52 in its most relaxed state, which occurs when the door 12 is overhead in its open position. To close the door, its outer edge not shown, is swung downwardly in a counterclockwise direction as seen in FIG. 1. This causes the lever 14 to swing around its pivot point 16 on bracket plate 18 to the position illustrated in phantom lines in FIG. 1. In doing that, it pulls cable 24 upwardly, causing the pulley 48 to rise within housing 36. As a result, the length of cable extending out of the top of the housing is increased by an amount equal to twice the range of upward movement of the pulley within said housing. When the door is fully closed, the pulley keeper 42 has compressed the spring 52 to the maximum extent possible within the limits of the illustrated system. This is in contradistinction to the situation in re a conventional spring-loaded garage door assembly where the counterbalancing springs are tightly stretched when the door is closed. As will be apparent to anyone familiar with spiral springs, stretch tension is far more likely to cause a spring to rupture than is compression stress in a spring. Accordingly, my novel spring assembly is substantially free of the greatest risk inherent in the use of a conventional spring-loaded garage door, namely, the risk of rupture of springs under tension and consequent possibility of damage to the surroundings from released spring fragments. Moreover, my novel spring assembly has a sturdy housing surrounding its spring element which would contain spring fragments in the unlikely event of spring breakage. Even without such a housing, a ruptured spring under compression would not pose the risk of flying fragments that a stretched tension spring poses, even where the latter has a central wire to prevent scattering of any fragments which encircle the wire.

Garage door 12 is opened by swinging its lower edge (not shown) upwardly in the clockwise direction, as seen in FIG. 1. As the door moves upwardly that part of cable 24 extending above housing 36 is pulled downwardly by the compression spring and as the door passes over center, with respect to pivot point 16, the force in the expanding spring 52 pulls downwardly on the right end of the lever 14 causing it to seesaw around the pivot and urge the door to the fully open position illustrated in FIG. 1.

I have found a compression spring of 950 lbs. dead pressure to be suitable for use in my novel spring assembly on the average two-car garage door. As previously indicated, a separate assembly must be installed on either side of the door as an alternative to the tension spring assembly now conventionally employed on either side of such a door. Adjustment of the assembly for use on a particular door can, again as previously indicated, be aided by varying the depth of pulley keeper 42 within housing 36 through manipulation of nut 54 and lock nut 56. By means of this adjustment, the pull of compression spring 52 and the travel distance of cable 24 can be varied to some extent. With my novel spring arrangement, I can achieve counterbalance pull variance of from approximately 150 to 450 lbs. and cable travel of from approximately 14 to 20 inches, the preferred spring pull and cable travel for a particular garage door being dependent upon the weight of the door. The adjusting bracket 64 has three hole positions 73 at any one of which the chain 66 can be secured to provide additional adjustability of spring assembly for individual door situations. As the drawing reveals, bracket 64 is U-shaped with parallel walls 71 apertured to provide the three hole positions, each position being defined by aligned holes in the two walls. A nut and bolt 75 provides the means for securing chain 66 to the bracket 64 at the chosen hole position, that position being the bottom one as illustrated in the drawing. The average two-car garage door of wooden construction weighs between 200 and 300 pounds. For doors heavier than this, stronger springs than my preferred 950 lb. dead pressure spring can be employed in my novel assembly to achieve preferred pull and cable travel requirements.

While the novel counterbalance spring assembly of this invention has been herein illustrated and described with emphasis on what is considered to be a preferred embodiment, it should be understood that various departures may be made therefrom within the scope of the invention, which scope extends to all variant forms of the invention encompassed by the language of the following claims.

I claim:

1. Spring means particularly adapted for use in place of spiral tension spring means in a conventional spring-loaded counterbalancing system with a kicker assembly for a garage door of the type designed to swing between a vertical closed position and a horizontal overhead open position, said spring means comprising, when installed for use:

a spiral compression spring;

a steeply sloping tubular housing for said spiral compression spring within which the spring is disposed in freely compressible condition;

a pulley disposed beneath the spiral compression spring in said tubular housing and adapted to move freely in the longitudinal direction therewithin;

a cable adapted to fit said pulley and means securing one end thereof against movement relative to said tubular housing at a point above the bottom of said compression spring, said cable being looped down around said pulley from its secured end and having its other end extending from the tubular housing and connected to said kicker assembly;

cooperating means permitting compression of said spiral compression spring by upward movement of said pulley in the tubular housing;

whereby closing of the garage door causes the kicker assembly to pull the cable upwardly and thereby raise the pulley within said tubular housing to compress said compression spring, and opening of the door is facilitated by properly directed pulling force thereon exerted through the pulley and cable by the expanding compression spring.

2. Spring means in accordance with claim 1 in which said tubular housing has two pairs of facing walls and is of generally square cross section.

3. Spring means in accordance with claim 2 which includes a detached top closure for the installed tubular housing against which the upper end of said compression spring abuts when in use, and stop means to prevent the closure from being forced out of the top of the housing by force exerted thereon by the compression spring.

4. Spring means in accordance with claim 3 in which said stop means comprises flanges formed by inturned portions of the tops of the housing walls.

5. Spring means in accordance with claim 4 including a keeper for said pulley and a rod fixedly secured to the top of said keeper, said rod extending coaxially upwardly from said keeper within the installed housing to an upper end, said top closure having an opening sized and positioned to slidably receive said rod and said rod being of a length to extend through said opening in all positions of use.

6. Spring means in accordance with claim 5 in which said rod is threaded from its upper end for at least a portion of its length and which includes nut means adapted for threaded engagement with said rod to aid in installation of the spring means and permit adjustment of the pull of the spring means and travel of the cable during usage of said spring means.

7. Spring means in accordance with claim 6 in which said pulley is mounted within said tubular housing with its axle extending diagonally between two corners of the housing, said axle being of a suitable length and properly beveled around its two ends to guide the pulley in a plane coincident with the other two corners of the housing in its travel path therewithin.

8. Spring means in accordance with claim 7 including bracket means for adjustably securing the bottom of said tubular housing to a garage door frame.

* * * * *